US011280532B2

(12) United States Patent
Sharma

(10) Patent No.: US 11,280,532 B2
(45) Date of Patent: Mar. 22, 2022

(54) EVAPORATOR ASSEMBLY FOR A HORIZONTAL TYPE ICE MAKING MACHINE

(71) Applicant: Ram Prakash Sharma, Gurgaon (IN)

(72) Inventor: Vinay Sharma, Gurgaon (IN)

(73) Assignee: Ram Prakash Sharma, Gurgaon (IN)

( * ) Notice: Subject to any disclaimer, the term of this patent is extended or adjusted under 35 U.S.C. 154(b) by 0 days.

(21) Appl. No.: 16/650,486

(22) PCT Filed: Nov. 23, 2018

(86) PCT No.: PCT/IB2018/059252
§ 371 (c)(1),
(2) Date: Mar. 25, 2020

(87) PCT Pub. No.: WO2019/102406
PCT Pub. Date: May 31, 2019

(65) Prior Publication Data

US 2021/0199363 A1 Jul. 1, 2021

(30) Foreign Application Priority Data

Nov. 23, 2017 (IN) ..... 201711042072

(51) Int. Cl.

| | |
|---|---|
| ***F25C 1/045*** | (2018.01) |
| ***F25B 39/02*** | (2006.01) |
| ***F25C 1/25*** | (2018.01) |
| ***F25C 1/246*** | (2018.01) |

(52) U.S. Cl.
CPC ..... *F25C 1/045* (2013.01); *F25B 39/02* (2013.01); *F25C 1/246* (2013.01); *F25C 1/25* (2018.01)

(58) Field of Classification Search
CPC .. F25B 39/02; F25C 1/045; F25C 1/08; F25C 1/25; F25C 1/246
See application file for complete search history.

(56) References Cited

U.S. PATENT DOCUMENTS 3,721,103 A * 3/1973 Brandt ..... F25C 1/04 62/73
4,899,548 A 2/1990 Dimijian
4,970,877 A * 11/1990 Dimijian ..... F25C 1/045 62/344

FOREIGN PATENT DOCUMENTS

KR 1020130110874 A 10/2013
KR 1020130110875 A 10/2013
(Continued)

*Primary Examiner* — Cassey D Bauer
(74) *Attorney, Agent, or Firm* — The Webb Law Firm

(57) ABSTRACT

Disclosed is an evaporator assembly for a horizontal type ice making machine. The evaporator assembly includes a plurality of tubes for circulating a refrigerant; a plurality of conductive protrusions, which are thermally coupled to and extending from each of the plurality of tubes; and a non-conductive plate, which is arranged adjacent to the plurality of tubes. The non-conductive plate is defined with a plurality of moulds, wherein each of the plurality of moulds is defined with a provision to receive one of the plurality of conductive protrusions. Each of the plurality of tubes includes a hemispherical structure, configured to enclose a top portion of the mould. The configuration of the evaporator assembly facilitates fast and efficient formation of ice, and there improves the efficiency of the ice making machine.

11 Claims, 8 Drawing Sheets

(56) References Cited

FOREIGN PATENT DOCUMENTS

| | | | |
|---|---|---|---|
| KR | 1020150025823 | A | 3/2015 |
| KR | 1020150031021 | A | 3/2015 |

* cited by examiner

EVAPORATOR ASSEMBLY FOR A HORIZONTAL TYPE ICE MAKING MACHINE

CROSS-REFERENCE TO RELATED APPLICATIONS

This application is the United States national phase of International Application No. PCT/IN2018/059252 filed Nov. 23, 2018, and claims priority to Indian Patent Application No. 201711042072 filed Nov. 23, 2017, the disclosures of which are hereby incorporated by reference in their entirety.

BACKGROUND

Field of the Invention

Present disclosure in general relates to a field of refrigeration. Particularly, but not exclusively, the disclosure relates to an ice making machine. Further, embodiments of the present disclosure disclose an evaporator assembly for a horizontal type ice making machine, to produce ice.

Description of Related Art

Ice may be formed by subjecting water or a liquid containing major percentage of water to a freezing temperatures i.e. sub-zero temperatures, which transits liquid state of water into solid state of water i.e. ice. Ice may be produced in different shapes and sizes based on the requirement and, this shape of the ice depends on the mould in which the ice is to be formed. Generally, ice formed in a cubical shape are used domestically in household beverages and drinks. A number of sectors such as but not limiting to the food/beverage sector, cold storage sectors and the like use ice in large quantities with specific requirement in shape and size. For example, ice in the form of big lumps and bulky blocks are used in the cold storage sector to store perishable goods for longer duration. Further, ice of smaller sizes are generally used in food/beverage sectors such as restaurants, hotels, bars and pubs. In recent times, the food and beverage industries are advancing towards satisfying customers not only through sense of taste, but also how the food or beverages are aesthetically appealing to the consumers. This trend has increased demand for ice in the food and beverage sectors. Especially, with regards to aesthetically appealing ice which goes into the drinks of the consumers. Also, the consumers prefer aesthetically appealing ice than the conventional cubical ice blocks.

Conventionally, forming of ice blocks involved manual process, in which a liquid i.e. water may be poured into the mould of specific shape to obtain ice based on the shape of the mould. Further, these moulds with the liquid are subjected to subzero temperatures to form the ice. This was a time consuming process as, water needed to be topped up in each the moulds to obtain ice. Moreover, this technique may result in non-uniformity in shape of the ice blocks formed as the amount of ice poured into each mould may vary. Also, during harvesting of the ice there may be a tendency of the ice blocks to break.

With advancement in technology, automatic ice making machines have been invented, which may minimize human intervention for producing ice. Generally, such kind of ice making machines are adapted in sectors which require ice in bulk quantities such as food or beverage sectors or industries. One such ice making device comprises, a constitution in which water to be frozen is stored within a water tank and is fed under pressure to a distributor pipe via a pump and injected through injection holes formed along said distributor pipe into a freezing chamber. This is then cooled by an evaporator connected to a freezing system, to form ice cakes within said freezing chamber. While part of the freezing water which is not frozen within said freezing chamber is fed back to said water tank for recirculation. The ice making chamber consists of a first freezing chamber having formed thereon a multiplicity of downwardly opening first freezing cells of a predetermined recessed shape.

Considering the above and with the advent of technology, ice making devices which may eliminate the use of moulds are developed. Such ice making machines includes a plate forming a plurality of through openings. A plurality of evaporator tips projects downwardly from the openings, and tips consists of heat conductive metal. The tips are tapered downwardly are surrounded by thermal material at a distal tip. Further, the device comprises a means for supplying a refrigerant fluid, on to the tips, to extract heat from at least some of the tips and thereby cool them to ice forming temperature. A second means is configured to spray water onto an under surface of the plate to drain down said isolators onto the tips, whereby ice progressively forms on the tips, and the tips may be subsequently heated to effect release of the ice from the tips to drop downwardly, for harvesting. However, such ice making machines and apparatus may be slow and inefficient at forming ice.

The present disclosure is directed to overcome one more problems stated above, or any other problem associated with the prior art.

The information disclosed in this background of the disclosure section is only for enhancement of understanding of the general background of the invention and should not be taken as an acknowledgment or any form of suggestion that this information forms the prior art already known to a person skilled in the art.

SUMMARY OF THE INVENTION

One or more shortcomings of conventional assemblies and processes are overcome and additional advantages are provided through the assembly and the process as claimed in the present disclosure. Additional features and advantages are realized through the techniques of the present disclosure. Other embodiments and aspects of the disclosure are described in detail herein and are considered a part of the claimed disclosure.

In a non-limiting embodiment of the disclosure, an evaporator assembly for a horizontal type ice making machine is disclosed. The evaporator assembly comprises a plurality of tubes for circulating a refrigerant. Further, the evaporator assembly comprises a plurality of conductive protrusions, which are thermally coupled to and extending from each of the plurality of tubes. Furthermore, the evaporator assembly comprises a non-conductive plate, which is arranged adjacent to the plurality of tubes. The non-conductive plate is defined with a plurality of moulds, wherein each of the plurality of moulds is defined with a provision to receive one of the plurality of conductive protrusions. Each of the plurality of moulds along with a corresponding conductive protrusion of the plurality of conductive protrusions, defines an ice forming region.

In an embodiment, each of the plurality of conductive protrusions extends, downwardly from a corresponding tube of the plurality of tubes.

In an embodiment, each of the plurality of moulds are hemispherical in shape and the hemispherical configuration of each of the plurality of moulds, facilitates in forming a spherical ice around the plurality of conductive protrusions.

In an embodiment, a plurality of conductive hemispherical structures thermally coupled to the plurality of tubes, wherein each of the plurality of conductive hemispherical structures is configured to enclose a top surface of one of the plurality of moulds.

In an embodiment, thermal conductivity of a material of the plurality of conductive protrusions is higher than the thermal conductivity of a material of the non-conductive plate.

In an embodiment, the plurality of tubes and the plurality of conductive protrusions are made of material selected from at least one of copper and aluminum.

In an embodiment, the non-conductive plate is manufactured of at least one of polymeric material and a metallic material with low thermal conductivity when compared to the material of the plurality of tubes and the plurality of conductive protrusions.

In an exemplary embodiment, a horizontal type ice making machine is disclosed. The machine comprises one or more evaporator assemblies, each of the one or more evaporator assemblies comprises a plurality of tubes for circulating a refrigerant. Further, the evaporator assembly comprises a plurality of conductive protrusions, which are thermally coupled to and extending from each of the plurality of tubes. Furthermore, the evaporator assembly comprises a non-conductive plate, which is arranged adjacent to the plurality of tubes. The non-conductive plate is defined with a plurality of moulds, wherein each of the plurality of moulds is defined with a provision to receive one of the plurality of conductive protrusions. Further, the ice making machine comprises a distribution unit, configured to distribute liquid on to each of the plurality of conductive protrusions and each of the plurality of moulds. The plurality of conductive protrusions exchanges heat with the refrigerant flowing through the plurality of tubes to form ice, on the plurality of conductive protrusions and the plurality of moulds. Additionally, the ice making machine comprises a storage compartment positioned at a bottom portion, wherein the storage compartment is adapted to store harvested ice from the evaporator assembly.

In an embodiment, the distribution unit comprises a storage tank for storing liquid and a plurality of sprayers that are fluidly connectable with the storage tank. Each of the plurality of sprayers are configured to impinge liquid on to each of the plurality of conductive protrusions and each of the plurality of moulds.

In an embodiment, the ice making machine comprises a housing, wherein the housing is configured to support the one or more evaporator assemblies, the plurality of tubes, the distribution unit and the storage compartment.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The novel features and characteristic of the disclosure are set forth in the appended claims. The disclosure itself, however, as well as a preferred mode of use, further objectives and advantages thereof, will best be understood by reference to the following detailed description of an illustrative embodiment when read in conjunction with the accompanying drawings. One or more embodiments are now described, by way of example only, with reference to the accompanying drawings wherein like reference numerals represent like elements and in which:

Figure 1:
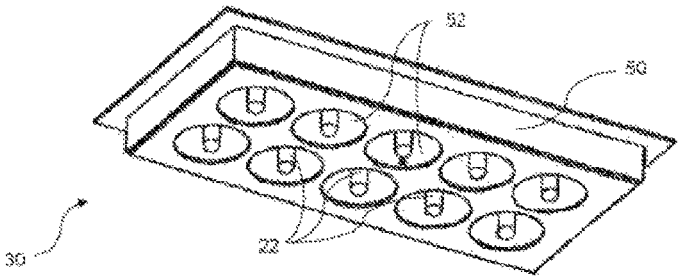
FIGS. 1 and 2*a*-2*b* illustrate a bottom and top perspective view of an evaporator assembly, in accordance with an exemplary embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DESCRIPTION OF THE INVENTION

While the embodiments in the disclosure are subject to various modifications and alternative forms, specific embodiment thereof have been shown by way of example in the figures and will be described below. It should be understood, however, that it is not intended to limit the disclosure to the particular forms disclosed, but on the contrary, the disclosure is to cover all modifications, equivalents, and alternative falling within the scope of the disclosure.

It is to be noted that a person skilled in the art would be motivated from the present disclosure and modify various aspects of the evaporator assembly. However, such modifications should be construed within the scope of the disclosure. Accordingly, the drawings show only those specific details that are pertinent to understand the embodiments of the present disclosure, so as not to obscure the disclosure with details that will be readily apparent to those of ordinary skill in the art having benefit of the description herein.

The terms "comprises", "comprising", or any other variations thereof used in the disclosure, are intended to cover a non-exclusive inclusion, such that a device, system, assembly that comprises a list of components does not include only those components but may include other components not expressly listed or inherent to such system, or assembly, or device. In other words, one or more elements in a system or device proceeded by "comprises . . . a" does not, without more constraints, preclude the existence of other elements or additional elements in the system or device.

Embodiments of the present disclosure discloses an evaporator assembly for a horizontal type ice making machine. The evaporator assembly is configured to facilitate formation of ice at sub-zero temperatures. Conventionally, various techniques have been developed to produce ice. However, such techniques demand for human intervention, which may lead to non-uniformity in formation of the ice. Further, with the advancement in technology, automatic ice making devices are developed. However, such existing automatic ice making machines are inefficient in forming the ice at required consistency and which may result in non-uniformity in shape of the ice formed. Additionally, these ice making machines may be subjected to thermal losses, which may affect efficiency of the ice making machine. The present disclosure aims at adapting an evaporator assembly in the ice making machine, to form ice of consistent shape and density with minimum thermal losses, and to increase efficiency and production of the ice making machine.

Accordingly, embodiments of the present disclosure, disclose the evaporator assembly for the horizontal type ice making machine. The evaporator assembly comprises a plurality of tubes for circulating a refrigerant. Further, the evaporator assembly comprises a plurality of conductive protrusions, which are thermally coupled to and extending from each of the plurality of tubes. Furthermore, the evaporator assembly comprises a non-conductive plate, which is arranged adjacent to the plurality of tubes. Each of the plurality of tubes comprises a hemispherical structure, configured to enclose a top portion of the mould. The non-conductive plate is defined with a plurality of moulds, wherein each of the plurality of moulds is defined with a provision to receive one of the plurality of conductive protrusions. Each of the plurality of moulds along with a corresponding conductive protrusion of the plurality of conductive protrusions, defines an ice forming region. The evaporator assembly of the present disclosure facilitates in fast and efficient formation of ice and with uniform shape consistency.

It should be appreciated that the term "liquid" is used throughout the specification to describe the substance distributed in the ice making machine which is used to make ice. In some embodiments, the liquid is water or at least has a high percentage of water content (thus, the liquid will act substantially as water would under the same conditions). It should be noted that the term "non-conductive plate" referred throughout the specification is member which may be made of less conductive material when compared to the projections. In other words, the conductivity of the non-conductive plate is very poor when compared to the conductivity of the projections.

The following paragraphs describe the present disclosure with reference to FIGS. 1 to 10. In the Figures, the same element or elements which have similar functions are indicated by the same reference signs.

Figure 2A:
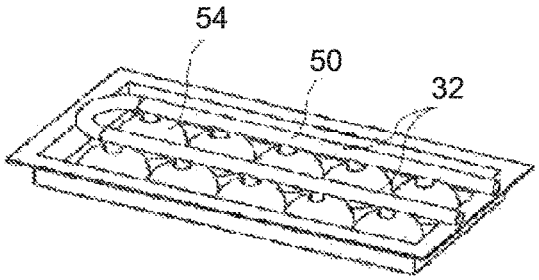
Figure 2B:
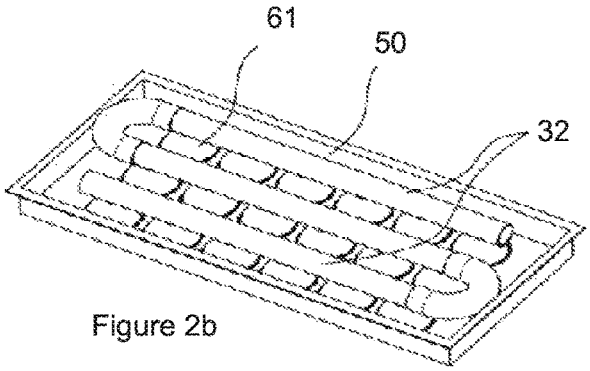
Figure 3:
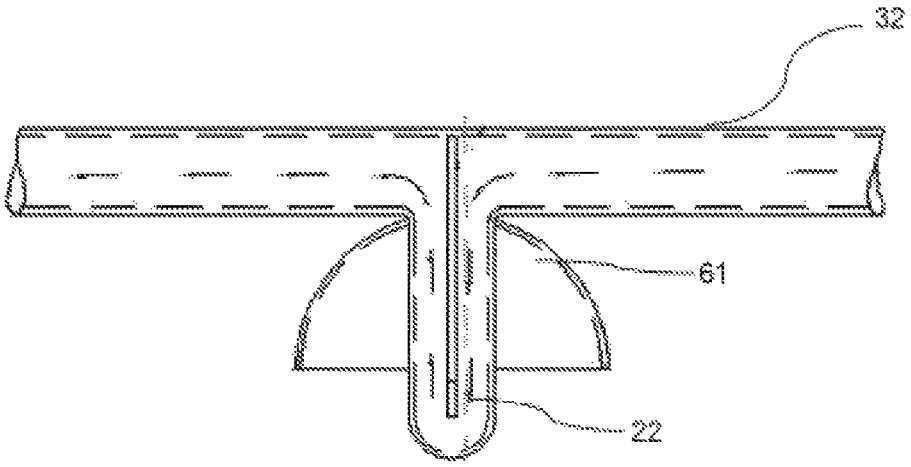
FIGS. 3 and 4 illustrates a sectional view of the plurality of protrusions integrated with the plurality of tubes, according to an exemplary embodiment of the present disclosure.
Figure 4:
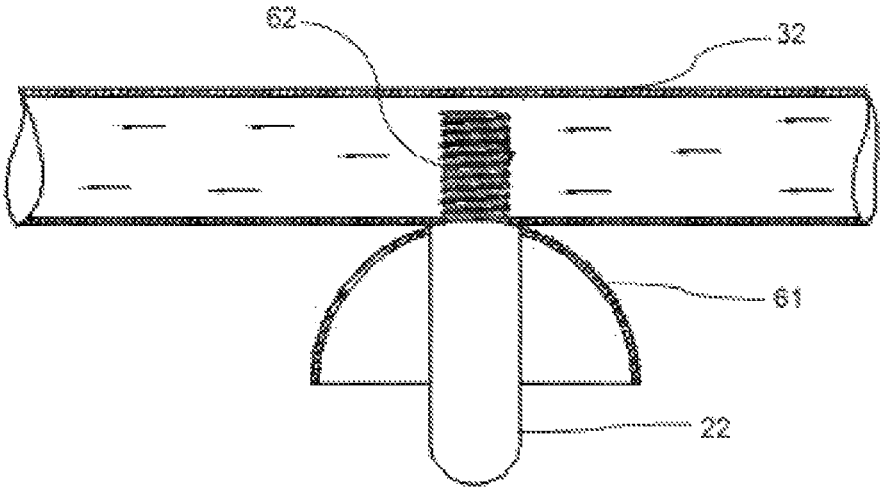

Referring to FIG. 1 and FIG. 2, which are exemplary embodiments of the disclosure illustrating bottom perspective and top perspective view of the evaporator assembly (30) for a horizontal type ice making machine (10). The evaporator assembly (30) comprises a plurality of tubes (32). Each of the plurality of tubes (32) are configured to circulate a refrigerant. The evaporator assembly (30) comprises a plurality of conductive protrusions (22). Each of the plurality of conductive protrusions (22) may be thermally coupled to and extend from each of the plurality of tubes (32). In an embodiment, each of the plurality of conductive protrusions (22) are configured to extend downwardly from each of the plurality of tubes (32). The plurality of conductive protrusions (22) may be arranged in the form an array i.e. in rows and columns or in a staggered manner. Arranging the plurality of conductive protrusions (22) in the form of the array may allow to position more number of conductive protrusions (22) in a given area of each of the plurality of tubes (32). Each of the plurality of conductive protrusions (22) may be configured to resemble a geometrical configuration such as, but not limiting to cylindrical configuration with an uniform cross-section. In an embodiment, each of the plurality of conductive protrusions (22) may be configured to exchange heat with the refrigerant circulating in each of the plurality of tubes (32) and thereby may define an ice forming region. In an embodiment, each of the plurality of protrusions (22) may be a hollow structure, which may provide provision for circulating the refrigerant within the plurality of protrusions (22) (best seen in FIG. 3), for effective cooling of the conductive protrusions (22). In an embodiment, each of the plurality of conductive protrusions (22) may be a solid structure, which may be thermally integrated with the plurality of tubes (32) (best seen in FIG. 4), the solid protrusion (22) may be defined with a plurality of fins (62) at an end, which may contact with the refrigerant flowing through each the plurality of tubes (32), for effective cooling the conductive protrusions (22). In an embodiment, each of the plurality of conductive protrusions (22) and each of the plurality of tubes (30) may be made of thermally conductive material. The thermally conductive material may be such as but not limiting to copper and aluminium, since copper and aluminium possess relatively high thermal conductivity. Also, each of the plurality of tubes (32) may be configured to circulate a warm fluid at the time of harvesting the formed ice on the plurality of protrusions (22).

Furthermore, as seen in FIGS. 1 and 2, the evaporator assembly (30) comprises a non-conductive plate (50). In an embodiment, the non-conductive plate (50) may be positioned adjacent and parallel to each of the plurality of tubes (32). The non-conductive plate (50) may be defined with a plurality of moulds (52). In an embodiment, each of the plurality of moulds (52) may be hemispherical in shape. Each of the plurality of moulds (52) are defined with a provision, to receive at least one conductive protrusion (22) of the plurality of conductive protrusions (22), such that each of the plurality of tubes (32) resides within the corresponding mould of the plurality of moulds (52) in the non-conductive plate (50). As an example, each of the plurality of conductive protrusions (22) may extend, substantially coaxially with a central axis of the plurality of moulds (52). In an embodiment, the non-conductive plate (50) may be made of material having thermal conductivity lesser than that of the material of each of the plurality of conductive protrusions (22). As an example, the material may be a polymeric material, whose thermal conductivity may be lesser than the material i.e. copper and aluminium of each of the plurality of conductive protrusions (22). In an embodiment, the rectangular shape of the non-conductive plate (50) is an exemplary embodiment and the same cannot be considered as limitation, as the non-conductive plate (50) may be configured in any geometrical shape such as but not limiting to square, circular and the like.

In an embodiment, the evaporator assembly (30) comprises a plurality of conductive hemispherical structures (61), which may be thermally coupled to the plurality of tubes (32). Each of the plurality of thermally conductive structures (61) are configured to enclose a top portion of the each of the plurality of moulds (52). The plurality of conductive protrusions (22) are positioned within the provisions defined in each of the plurality of moulds (52). In an embodiment, enclosing the top surface (54) of each of the plurality of moulds (52) by the thermally conductive hemispherical structure (61), facilitates in increased thermal conductivity, which in turn facilitates in improving efficiency of ice forming within the plurality of the moulds. Further, due to increased thermal conductivity, during harvesting, the ice formed within the plurality of moulds (52) and around the plurality of conductive protrusions (22) may be harvested quickly by passing warm fluid within the plurality of tubes (32).

Figure 5A:
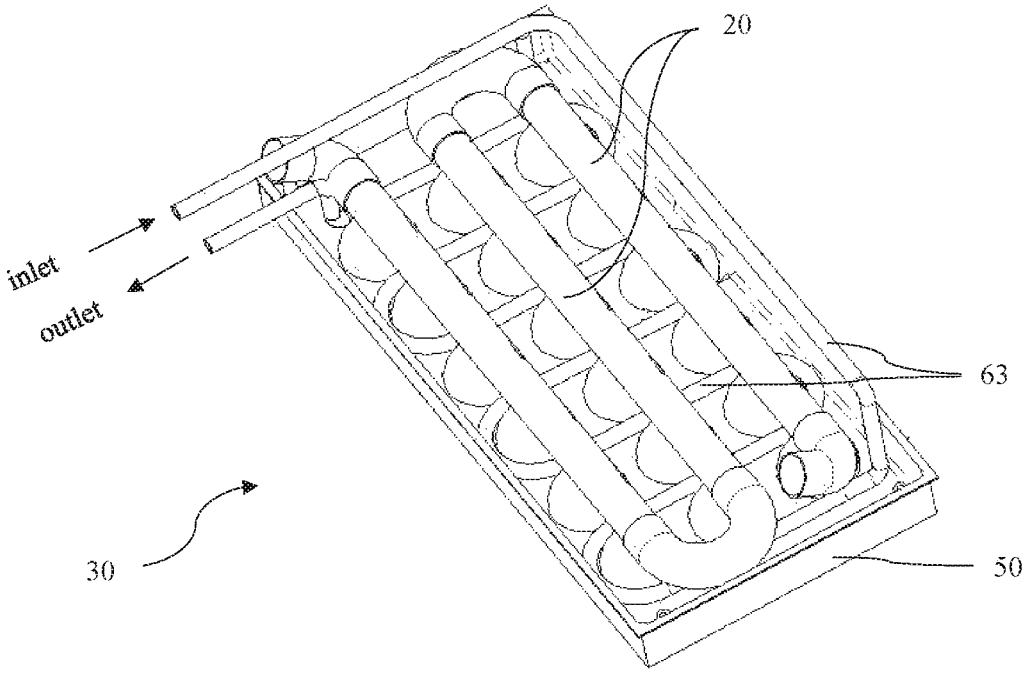
FIGS. 5*a* and 5*b*, illustrates a perspective view and a top view of the evaporator assembly, including a warming mechanism respectively, in accordance with an exemplary embodiment of the present disclosure.
Figure 5B:
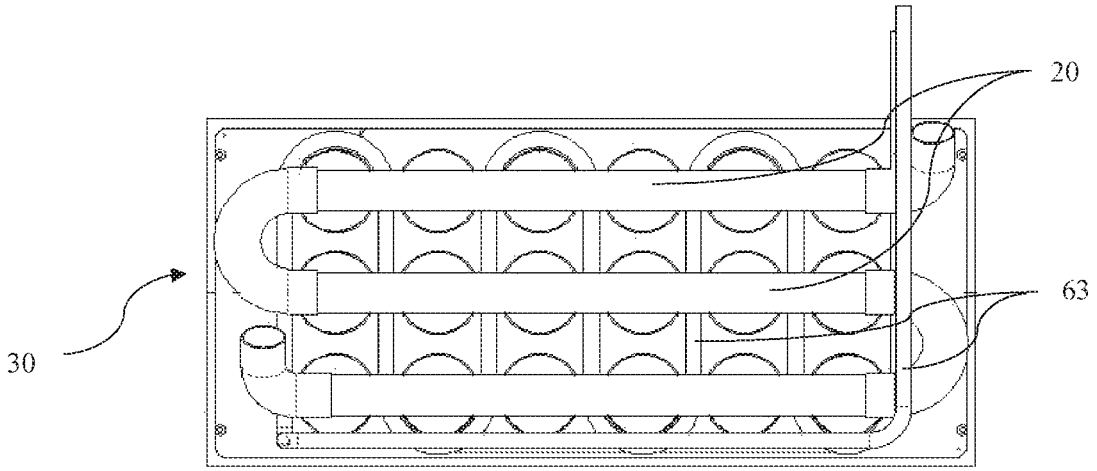

Now referring to FIGS. 5*a* and 5*b*, the evaporator assembly (30) may be configured with a warming mechanism. The warming mechanism may include a auxiliary pipe line (63), arranged in on a top surface of the non-conductive plate (50). The auxiliary pipe (63) has an inlet for the warm fluid to enter and an outlet for the warm fluid to exit. The auxiliary pipe line (63) is configured such that, it contacts each of the plurality of moulds (52). The auxiliary pipe line (63) is configured to circulate the warm fluid. This may facilitate in increasing the temperature of the plurality of moulds (52) during harvesting of the ice.

Figure 6:
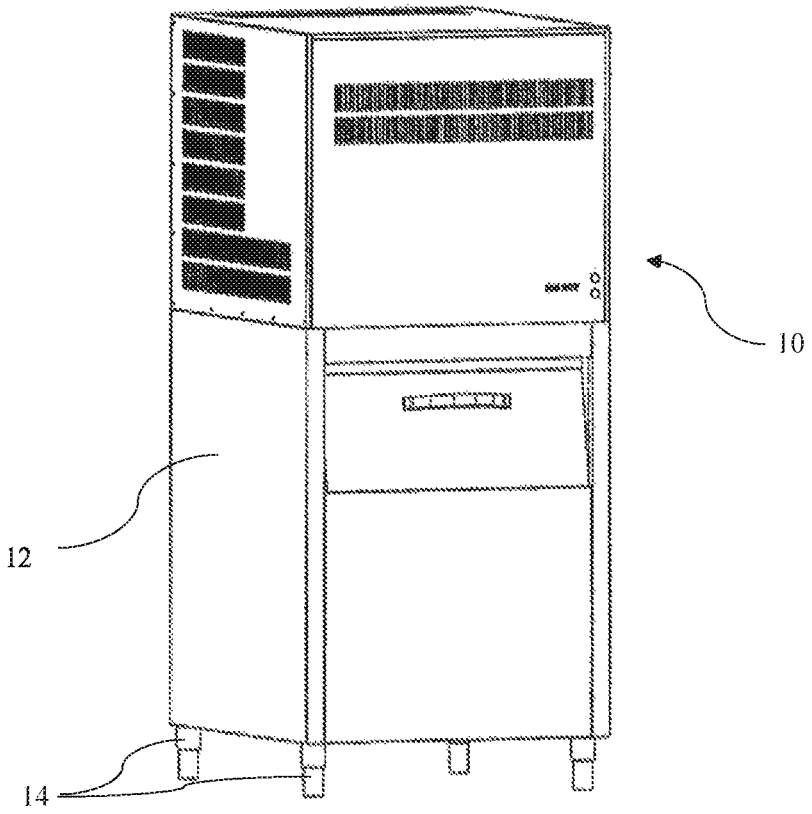
FIG. 6, illustrates a perspective view of a horizontal type ice making machine employed with the evaporator assembly of FIG. 1.
Figure 7:
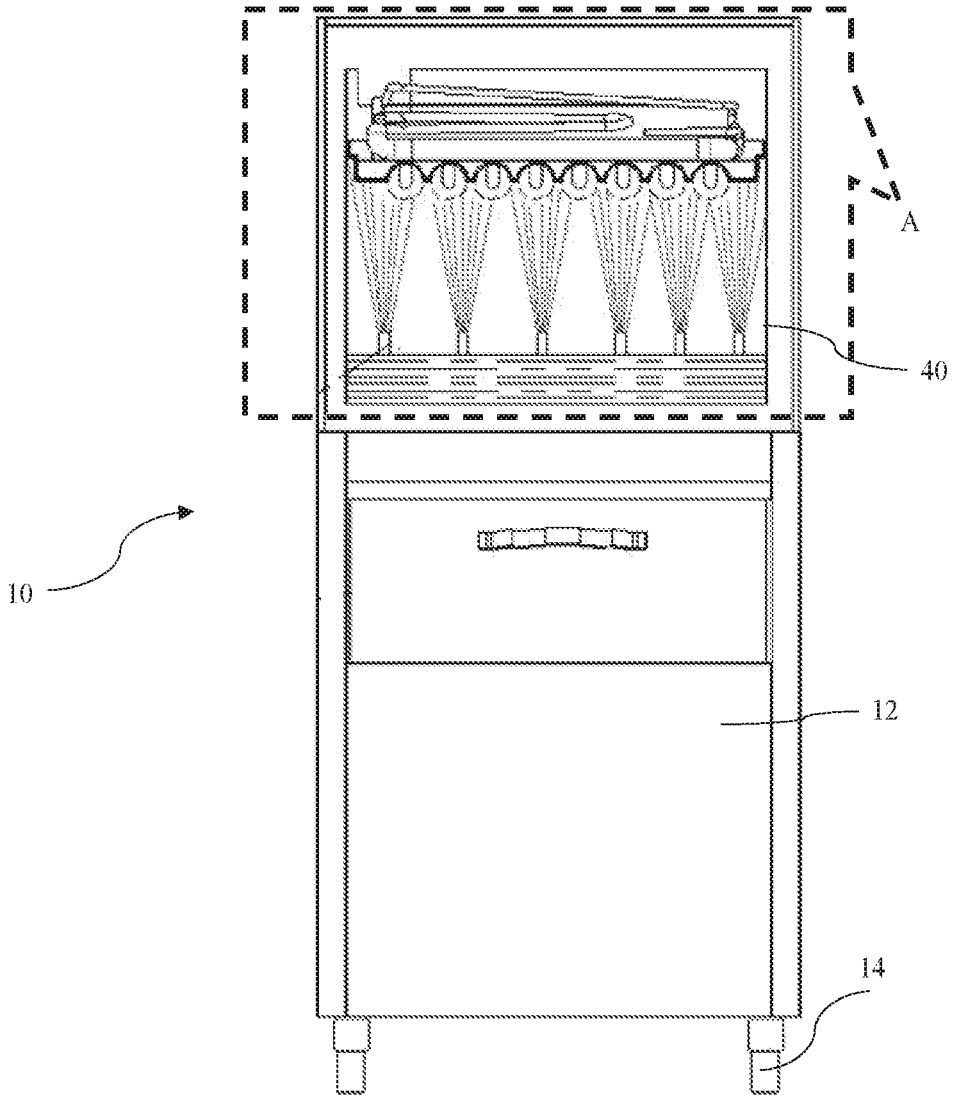
FIG. 7, illustrates a sectional view of the horizontal type ice making machine of FIG. 6.

FIGS. 6 and 7, are exemplary embodiments of the present disclosure, which disclose a perspective view and a front view of the horizontal type ice making machine (10) (hereinafter referred as ice making machine). As shown in FIG. 6, the horizontal type ice making machine (10) may be employed with one or more evaporator assemblies (30) for producing individual ice blocks of desired shape. Further, the ice making machine (10) may include a housing (12), which may be segregated into number of compartments to accommodate different components of the ice making machine (10). In an embodiment, the housing (12) may be provided with a plurality of ground engaging members (14), which may facilitate in movement of the ice making machine (10).

Now referring to FIG. 7, the ice making machine (10) may include a distribution unit (40). In an embodiment, the distribution unit (40) may be configured to impinge liquid onto each of the plurality of conductive protrusions (22) and the each of the plurality of moulds (52). The distribution unit (40) may comprise a storage tank (44). In an embodiment, the storage tank (44) may be configured to store the liquid, which may be utilized for forming ice. The storage tank (44) may be of any capacity, and may depend on the number of evaporator assemblies (30) employed therein. In an embodiment, the storage tank (44) may be configured with a chiller unit (not shown in figures), for cooling the liquid held in the storage tank (44). It should be appreciated that there are variety of chilling systems that could provide the required chilling of the liquid in the storage tank (44) and the above list should not be considered exhaustive.

Further, the distribution unit (40) comprises a plurality of sprayers (42), which may be fluidly connectable with the storage tank (44). Each of the plurality of sprayers (42) are configured to impinge liquid on to each of the plurality of conductive protrusions (22) and each of the plurality of moulds (52), to form the ice. In an embodiment, the distribution unit (40) may be positioned at a predetermined distance, below the evaporator assembly (30). Furthermore, the ice making machine (10) may include a support member (not shown in figures), which may be disposed between the evaporator assembly (30) and a part of the distribution unit (40). In an embodiment, the support member may facilitate in supporting and guiding the ice detached or harvested from each of the plurality of conductive protrusions (22), for storing.

Additionally, the ice making machine (10) comprises a storage compartment (not shown), which may be configured at a bottom portion of the ice making machine (10), to store the harvested ice. In an embodiment, the storage compartment may be cooled to a suitable temperature. As an example, the storage unit may be cooled, below zero degree centigrade, in order to avoid the stored ice from melting.

Operation of the ice making machine (10) for forming ice may be explained in two cycles such as cooling cycle and harvest cycle. The process of ice formation, is illustrated with respect to formation of a single block and one should not construe it as a limitation, as a number of ice blocks may be formed simultaneously in each of the plurality of conductive protrusions (22) and each of the plurality of moulds (52).

During the operation of the ice making machine (10), i.e. during cooling cycle, the refrigerant may be circulated through each of the plurality of tubes (32). The conductive protrusion (22) may exchange heat with the refrigerant circulating through each of the plurality of tubes (32), which facilitates in cooling each of the conductive protrusion (22). Further, the hemispherical structure (61) enclosing the mould (52), may facilitate in cooling the plurality of moulds (52), by exchanging heat with the refrigerant circulating through each of the plurality of tubes (32), to a predetermined temperature. As an example, the predetermined temperature may be equal to or less than zero degree centigrade.

Figure 8:
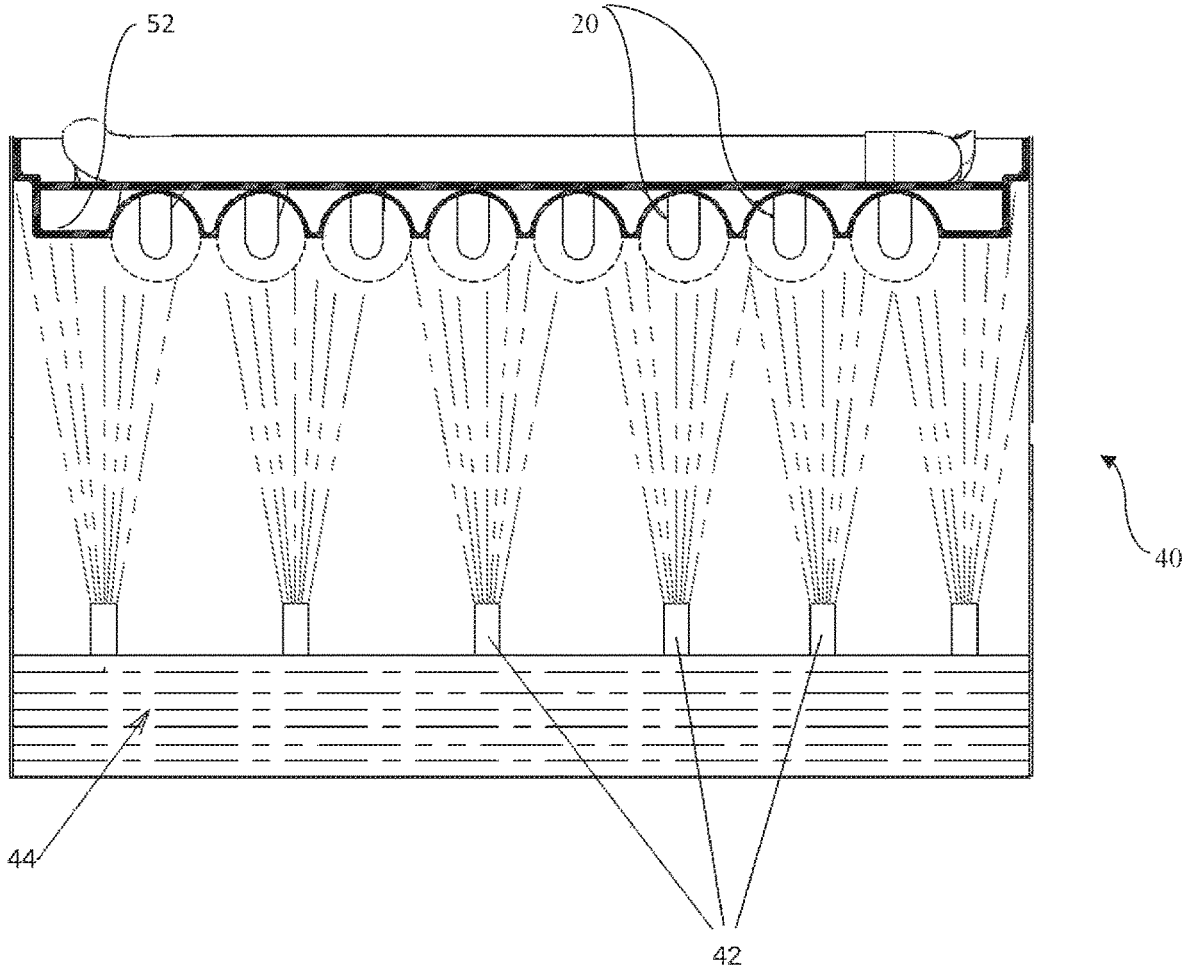
FIG. 8, illustrates enlarged view of portion A of FIG. 7.
Figure 9A:
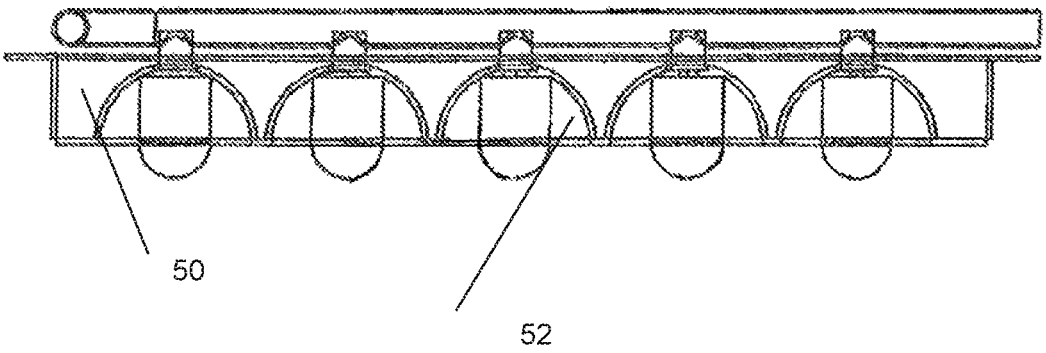
FIGS. 9*a*-9*b*, illustrates sectional views of the evaporator assembly of FIG. 1 in ice forming cycle.
Figure 9B:
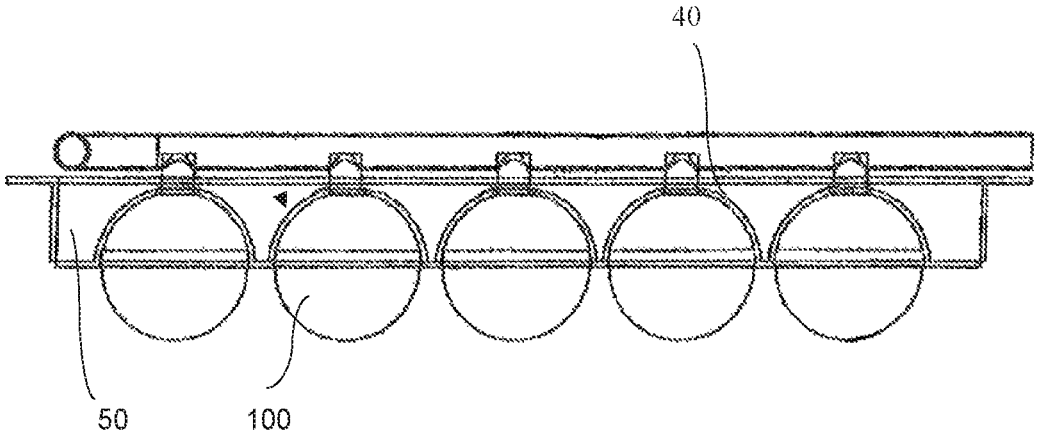
Figure 10:
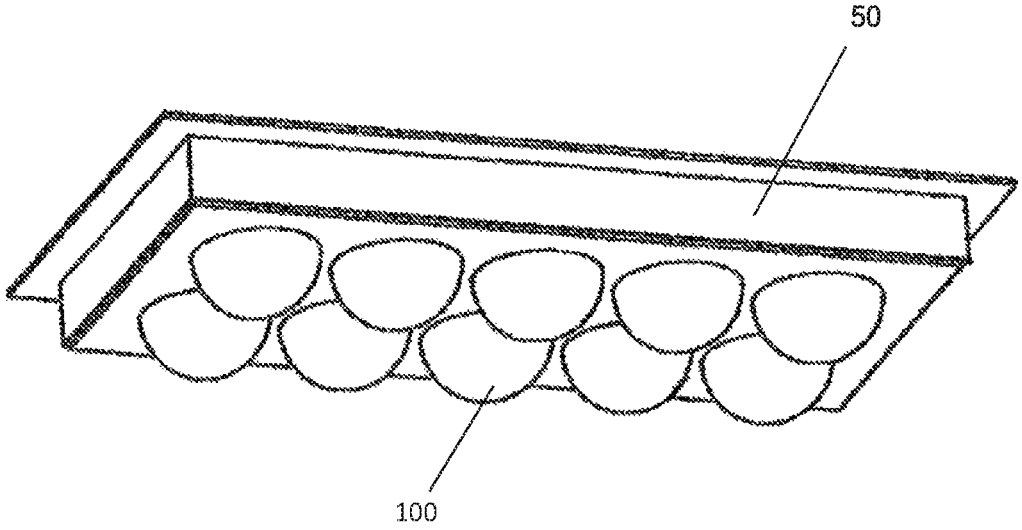
FIG. 10, illustrates a perspective view of the evaporator assembly of FIG. 1, with ice formed in the evaporator assembly.
Figure 11:
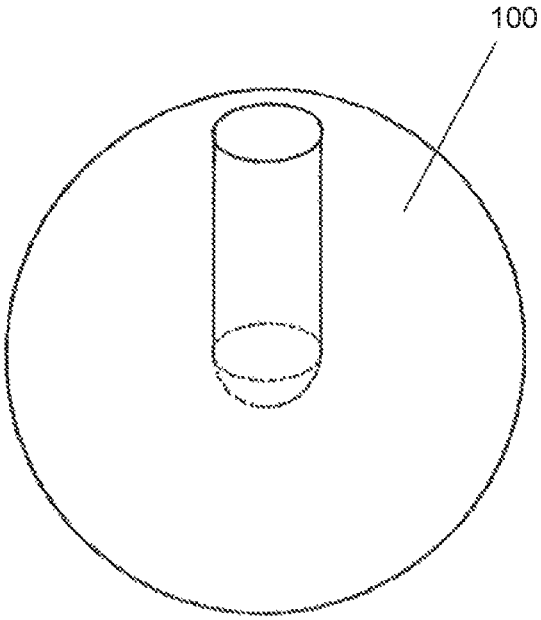
FIG. 11, illustrates a perspective view of a spherical ice, in accordance to an exemplary embodiment of the present disclosure.

Once, the protrusion (22) and the mould (52) have attained the pre-determined temperature, the liquid stored in the storage unit may be impinged on to the conductive protrusion (22) and the mould (52) via the plurality of sprayers (42) (best seen in FIG. 8). As the liquid is impinged onto the protrusions (22) and the mould (52), ice begins to form around each of the plurality of conductive protrusion (22), layer by layer (best seen in FIG. 9*a*). During formation of the ice, the sprayed water impinges on the plurality of protrusions and within the plurality of moulds. The impinged water drips downward due to gravity and trickles down on the protrusion (22). Since the conductive protrusion (22) is of lesser temperature than that of the mould (52), ice formation occurs around the protrusion. In an embodiment, the ice formed on each of the plurality of conductive protrusions (22), may expand symmetrically from a surface of the conductive protrusions (22). Further, the ice formed on the conductive protrusions (22) may expand into the mould (52). In an embodiment, the hemispherical moulds (52) guides a shape of an upper surface of the ice. As more liquid is impinged on to the conductive protrusion (22), the ice continues to expand symmetrically, and a lower surface of the ice will be formed in the same shape of that of the upper surface of the ice (best seen in FIG. 9*b*). Hence, a spherical ice block (100) may be formed (best seen in FIGS. 10 and 11). In an embodiment, the hemispherical configuration of the mould (52) along with the conductive protrusion (22), facilitates in forming a spherical ice block around the conductive protrusion (52). Further, positioning of the distribution unit (40) with respect to the conductive protrusion (22), also aids in forming the spherical ice around the conductive protrusion (22).

In an embodiment, uniform cross-section of each of the plurality of conductive protrusion (22), facilitates in creating a smaller void within the formed spherical ice block.

In an embodiment, cooling and impinging liquid onto each of the plurality of conductive protrusions (22) and each of the plurality of moulds (52), may be performed simultaneously.

In an embodiment, hemispherical shape of each of the plurality of moulds (52), is an exemplary embodiment, for forming spherical ice block, and the same may not be construed as a limitation. However, different configuration of the moulds (52) may be defined in the non-conductive plate (50), such as but not limiting to square, oval and the like, based on the shape of the ice block required.

During the operation of the ice making machine (10), i.e. during harvest cycle, warm fluid may be circulated through the plurality of tubes (32). The warm fluid may rise the temperature of the plurality of tubes (32), which in turn rise the temperature of the conductive protrusion (22) and the mould (52). Increase in temperature of the conductive protrusion (22) and the mould (52), increases the temperature of a layer of the ice adjacent or contacting the surface of the conductive protrusion (22) and the mould (52). This results the layer of the ice adjacent or contacting the surface of the conductive protrusion (22), to melt. This, facilitates the ice to detach from the protrusion (22) and the mould (52).

In an embodiment, use of one or more conductive protrusions (22) in combination with the moulds (52) may assist in fast and efficient formation of the ice in accordance with embodiments. The provision of moulds (52) may help to ensure uniform and regular shape of the ice blocks.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A. B, and C" would include but not be limited to systems that have A alone, B alone, C alone, A and B together, A and C together, B and C together, and/or A, B, and C together, etc.). In those instances, where a convention analogous to "at least one of A, B, or C, etc." is used, in general such a construction is intended in the sense one having skill in the art would understand the convention (e.g., "a system having at least one of A. B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

REFERRAL NUMERALS

| Description | Referral numeral |
|---|---|
| Ice making machine | 10 |
| Housing of the ice making machine | 12 |
| Ground engaging means | 14 |
| Plurality of protrusions | 22 |
| Evaporator assembly | 30 |
| Plurality of tubes | 32 |
| Distribution unit | 40 |
| Sprayer | 42 |
| Storage tank | 44 |
| Non-conductive plate | 50 |
| Plurality of moulds | 52 |
| Hemispherical structure | 61 |
| Fins | 62 |
| Spherical ice | 100 |

I claim:

1. An evaporator assembly for a horizontal type ice making machine, the assembly comprising:

a plurality of tubes for circulating a refrigerant;

a plurality of conductive protrusions, thermally coupled to and extending from each of the plurality of tubes;

a non-conductive plate arranged adjacent to the plurality of tubes, the non-conductive plate is defined with a plurality of moulds, wherein each of the plurality of moulds is defined with a provision to receive one of the plurality of conductive protrusions; and wherein each of the plurality of moulds along with a corresponding conductive protrusion of the plurality of conductive protrusions, defines an ice forming region, and a plurality of conductive hemispherical structures thermally coupled to the plurality of tubes, wherein each of the plurality of conductive hemispherical structures is configured to enclose a top surface of one of the plurality of moulds.

2. The assembly as claimed in claim 1, wherein each of the plurality of conductive protrusions extends, downwardly from a corresponding tube of the plurality of tubes.

3. The assembly as claimed in claim 1, wherein each of the plurality of moulds are hemispherical in shape.

4. The assembly claimed in claim 3, wherein the hemispherical configuration of each of the plurality of moulds, facilitates in forming a spherical ice around the plurality of conductive protrusions.

5. The assembly as claimed in claim 1, further comprising a warming mechanism, wherein the warming mechanism includes an auxiliary pipe line arranged on a top surface of the non-conductive plate, to circulate a warm fluid.

6. The assembly as claimed in claim 1, wherein thermal conductivity of a material of the plurality of conductive protrusions is higher than the thermal conductivity of a material of the non-conductive plate.

7. The assembly as claimed in claim 1, wherein the plurality of tubes and the plurality of conductive protrusions are made of a material selected from at least one of copper and aluminum.

8. The assembly as claimed in claim 1, wherein the non-conductive plate is made of at least one of polymeric material and a metallic material with low thermal conductivity when compared to the material of the plurality of tubes and the plurality of conductive protrusions.

9. A horizontal type ice making machine, the machine comprising:

one or more evaporator assemblies, each of the one or more evaporator assemblies comprising:

a plurality of tubes for circulating a refrigerant;

a plurality of conductive protrusions, thermally coupled to and extending from each of the plurality of tubes; and a non-conductive plate arranged adjacent to the plurality of tubes, the non-conductive plate is defined with a plurality of moulds, wherein each of the plurality of moulds are defined with a provision to receive one of the plurality of conductive protrusions;

a plurality of conductive hemispherical structures thermally coupled to the plurality of tubes, wherein each of the plurality of conductive hemispherical structures is configured to enclose a top surface of one of the plurality of moulds;

a distribution unit, configured to distribute liquid on to each of the plurality of conductive protrusions and each of the plurality of moulds;

wherein, the plurality of conductive protrusions exchanges heat with the refrigerant flowing through the plurality of tubes to form ice, on the plurality of conductive protrusions the plurality of moulds; and a storage compartment positioned at a bottom portion, wherein the storage compartment is adapted to store harvested ice from the evaporator assembly.

10. The machine as claimed in claim 8, wherein the distribution unit comprises a storage tank for storing liquid and a plurality of sprayers fluidly connectable with the storage tank, and wherein each of the plurality of sprayers are configured to impinge liquid on to each of the plurality of conductive protrusion and each of the plurality of moulds.

11. The machine as claimed in claim 8, further comprising a housing, wherein the housing is configured to support the one or more evaporator assemblies, the plurality of tubes, the distribution unit and the storage compartment.

* * * * *